US007160588B2

(12) United States Patent
Sanford et al.

(10) Patent No.: US 7,160,588 B2
(45) Date of Patent: Jan. 9, 2007

(54) ARTIFICIAL CHRISTMAS TREE AND COVER SYSTEM

(76) Inventors: Judith L. Sanford, 18177 Joplin Rd., Triangle, VA (US) 22172; Earl R. Sanford, 18177 Joplin Rd., Triangle, VA (US) 22172

( * ) Notice: Subject to any disclaimer, the term of this patent is extended or adjusted under 35 U.S.C. 154(b) by 130 days.

(21) Appl. No.: 10/988,606

(22) Filed: Nov. 16, 2004

(65) Prior Publication Data

US 2006/0105119 A1 May 18, 2006

(51) Int. Cl.

| | |
|---|---|
| ***A47G 33/06*** | (2006.01) |
| ***A41G 1/00*** | (2006.01) |
| ***B65D 85/52*** | (2006.01) |
| ***B65D 30/28*** | (2006.01) |

(52) U.S. Cl. ..... 428/18; 206/423; 47/23.2; 150/158; 294/137

(58) Field of Classification Search ..... 428/18, 428/19, 20; D11/118; 47/23.2; 108/90; 150/158; 206/423; 294/137, 170
See application file for complete search history.

(56) References Cited

U.S. PATENT DOCUMENTS

| | | | | |
|---|---|---|---|---|
| 1,662,091 A | | 3/1928 | Vuozzo | |
| 3,405,895 A | * | 10/1968 | Perkins | 108/25 |
| 4,054,166 A | | 10/1977 | Burke | |
| 4,206,795 A | * | 6/1980 | Regan | 206/423 |
| 4,838,293 A | | 6/1989 | Novak | |
| 5,388,799 A | | 2/1995 | Keefe | |
| 5,590,775 A | * | 1/1997 | Moore | 206/423 |
| 6,270,864 B1 | | 8/2001 | Weiss | |
| 6,698,135 B1 | | 3/2004 | Robbins | |

FOREIGN PATENT DOCUMENTS

| | | | |
|---|---|---|---|
| EP | 1410748 A1 | * | 4/2004 |
| WO | WO 2005016086 A1 | * | 2/2005 |

* cited by examiner

*Primary Examiner*—Jennifer C. McNeil
*Assistant Examiner*—Aaron Austin
(74) *Attorney, Agent, or Firm*—Richard C. Litman

(57) ABSTRACT

An artificial Christmas tree and storage cover a trunk and progressively larger branches from the top to near the base of the tree. The tree trunk rests in a central bore of a frustoconical base and has at least three swivel castor wheels mounted on the lower wall, providing movable support for the tree assembly. At least one castor wheel has a foot-operated brake. A conical cover covers the standing, decorated tree and attaches to the base. The cover has flaps spaced along one vertical edge of the cover and receiving mating patches spaced along an opposite edge the flaps and mating patches having VELCRO, hook and loop material on the mating surfaces thereof. The cover has three triangular portions each having mating flaps and patches in turn. The base and the lower end of the cover have mating strips of hook and loop material.

19 Claims, 5 Drawing Sheets

ARTIFICIAL CHRISTMAS TREE AND COVER SYSTEM

BACKGROUND OF THE INVENTION

1. Field of the Invention

The present invention relates to artificial Christmas trees. More particularly, the present invention relates to artificial Christmas trees having a removable cover.

2. Description of the Related Art

Artificial Christmas trees are widely used as a Holiday decoration. They are reusable and thus avoid the cost of purchase and disposal of a natural tree. Present artificial Christmas trees which simulate a large, freestanding tree require laborious assembly and disassembly and must be redecorated each year. Also, such trees are difficult if not impossible to move once erected. It would be desirable to provide a large, free-standing Christmas tree which is easily moved while assembled, and may be left erect and decorated between Christmas seasons. It would also be desirable to provide such a tree which has a base and cover which protects the tree from dust and damage between seasons.

None of the above inventions and patents, taken either singly or in combination, is seen to describe the instant invention as claimed. Thus an artificial Christmas tree and storage cover assembly solving the aforementioned problems is desired.

SUMMARY OF THE INVENTION

The artificial Christmas tree and storage cover system of the present invention includes an upper, a central, and a lower section in which each has a central vertical support tube acting as a trunk and progressively larger branches from the top to near the base of the tree. Each section is supported in turn by its central support tube sliding into a support sleeve at the top of the next lower support tube. The support tube for the lower section rests in the central bore of a base.

The base is frustoconical in shape, having circular, horizontal upper and lower walls with a slanting sidewall. The central bore extends axially downward and inward for a distance and of a diameter to receive the support tube of he lower tree section and to hold the tree in a steady, upright position. The base is of sufficient weight to hold the assembled and decorated tree upright. The tree base has at least three swivel castor wheels mounted on the lower wall and distributed so as to provide movable support for the tree assembly. At least one, and preferably all of the swivel castor wheels have a foot-operated brake as well known and commercially available.

A conical cover is provided which may be manipulated to cover the standing, decorated tree and attach to the base. The cover has a plurality of flaps spaced along one vertical edge of the cover and a plurality of receiving mating patches spaced along an opposite edge the flaps and mating patches having VELCRO, hook and loop material on the mating surfaces thereof. The cover preferably has three generally triangular portions which each have mating flaps and patches in turn. The base and the lower end of the cover have mating strips of hook and loop material thereon to help support the cover during storage. The cover has at least one handle thereon at a convenient height for pulling the covered tree to a location for display.

The tree may easily be uncovered by separating the flaps from the patches of mating hook and loop material and removing the cover therefrom. To store the tree, the cover is easily reinstalled and pulled to a storage room by use of the handle and castor wheels.

It is an aspect of the invention to provide improved elements and arrangements thereof for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is an artificial Christmas tree having a wheeled base and a cover system such the tree may store while remaining decorated between Christmas seasons.

Figure 1:
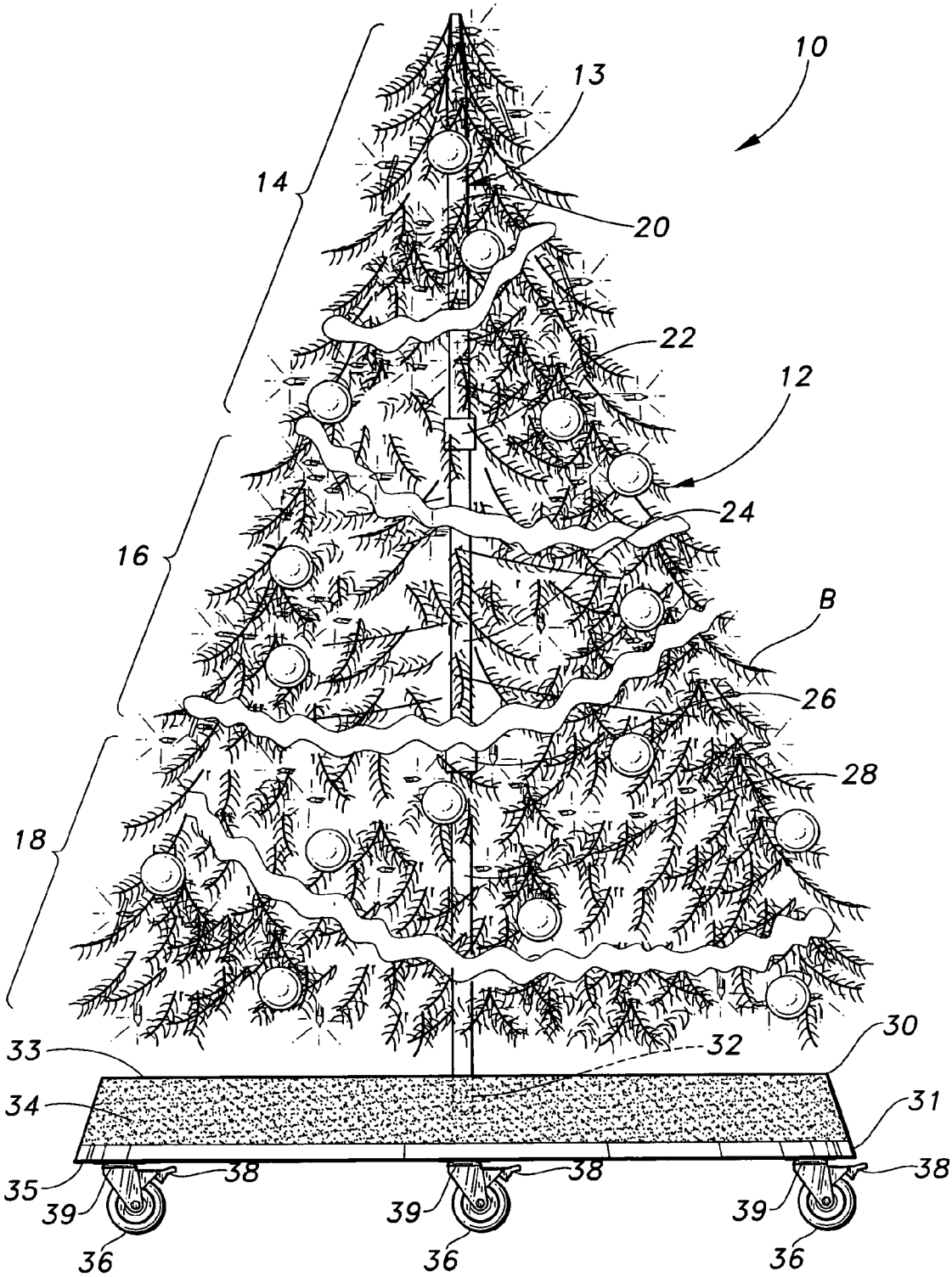
FIG. 1 is a side elevation view of an artificial Christmas tree and cover system according to the present invention.

Referring to FIG. 1, there is shown the artificial Christmas tree 12 of the artificial Christmas tree and cover system 10. Artificial tree 12 includes a central trunk 13 having branches or limbs B, an upper trunk section 14, a center trunk section 16, and a lower trunk section 18 having progressively longer branches or limbs B from upper trunk section 14 through lower trunk section 18. Alternatively, each trunk section may individually have progressively longer braches or limbs B to limit the width of tree for easy movement of the assembled tree through doorways. The upper trunk section 14 is centrally supported by upper trunk tube 20 supported at its lower end by upper trunk receiver sleeve 22 of center trunk tube 24, which centrally supports central trunk section 16. Center trunk tube 24 is supported at its lower end by center trunk receiver sleeve 26 of lower trunk tube 28, which centrally supports lower trunk section 18.

Base 30 is generally frustoconical in shape, having a lower trunk receiver bore 32 located axially and extending downward into base 30 for receiving the lower end of lower trunk tube 28. The lower trunk receiver bore 32 is of sufficient depth and diameter to support and hold tree 12 in a vertical position. Base 30 has a peripheral sidewall 31 sloping between horizontally disposed upper wall 33 and a lower wall 35, upper wall 33 defining the entrance of trunk receiver bore 32. Sidewall 31 extends between the respective circumferences of upper wall 33 and lower wall 35 and is at least partially covered by a surrounding strip 34 of hook and loop material (VELCRO), preferably loop material.

At least three swivel castor wheels 36 are spaced around the periphery of lower wall 35 of base 30, each having brakes 38, and are attached to base lower wall 35 by rotating castor mountings 39 so as to movably support base 30 and artificial tree 12. Base 30 is of sufficient weight to keep artificial tree 12 from tilting and falling over on its side.

Brakes 38 may be set to keep artificial tree 12 in a desired location. The swivel castor wheels with brakes are well-known, commercial items.

Figure 2A:
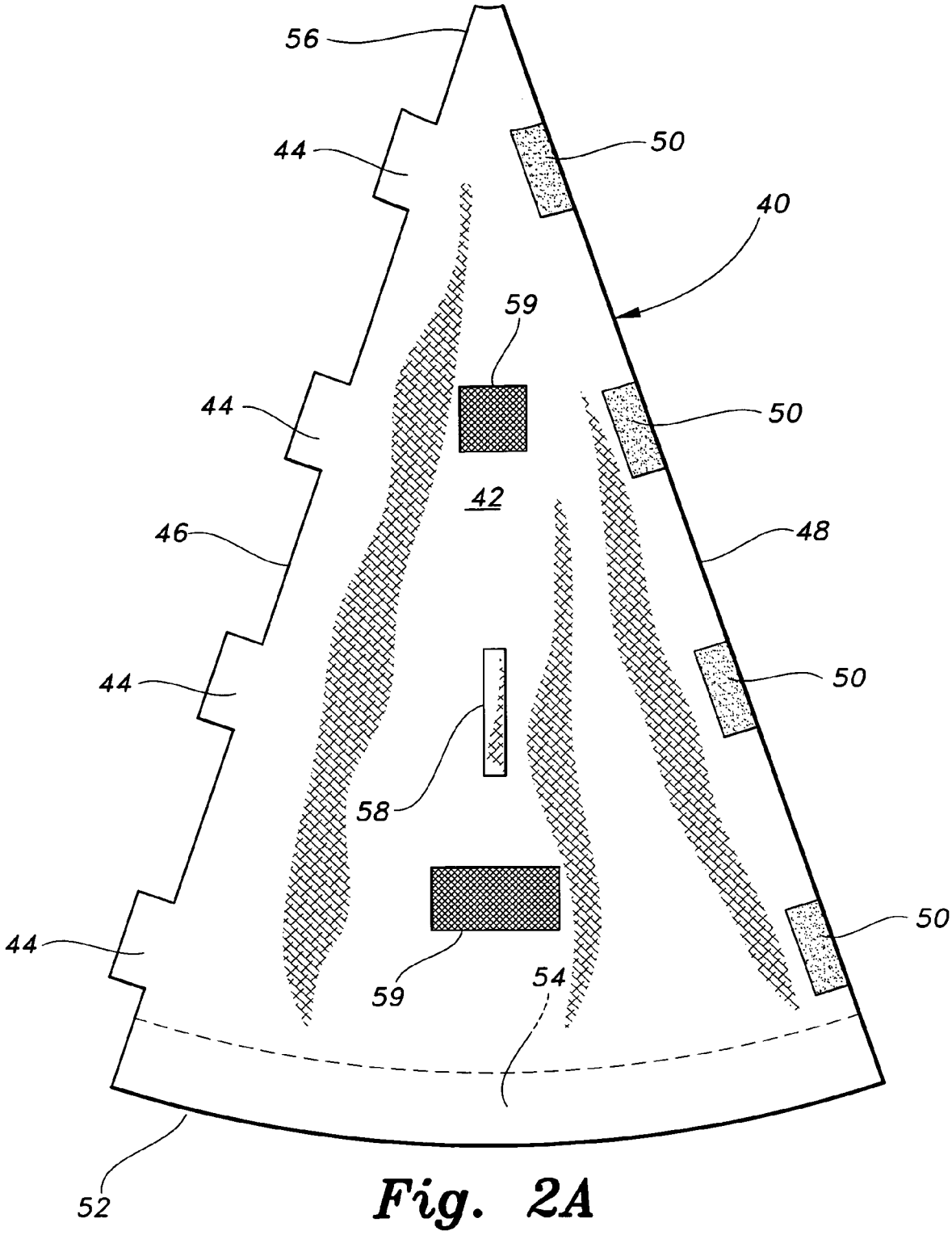
FIG. 2A is an outer side plan view of a cover section of the artificial tree system of FIG. 1.
Figure 2B:
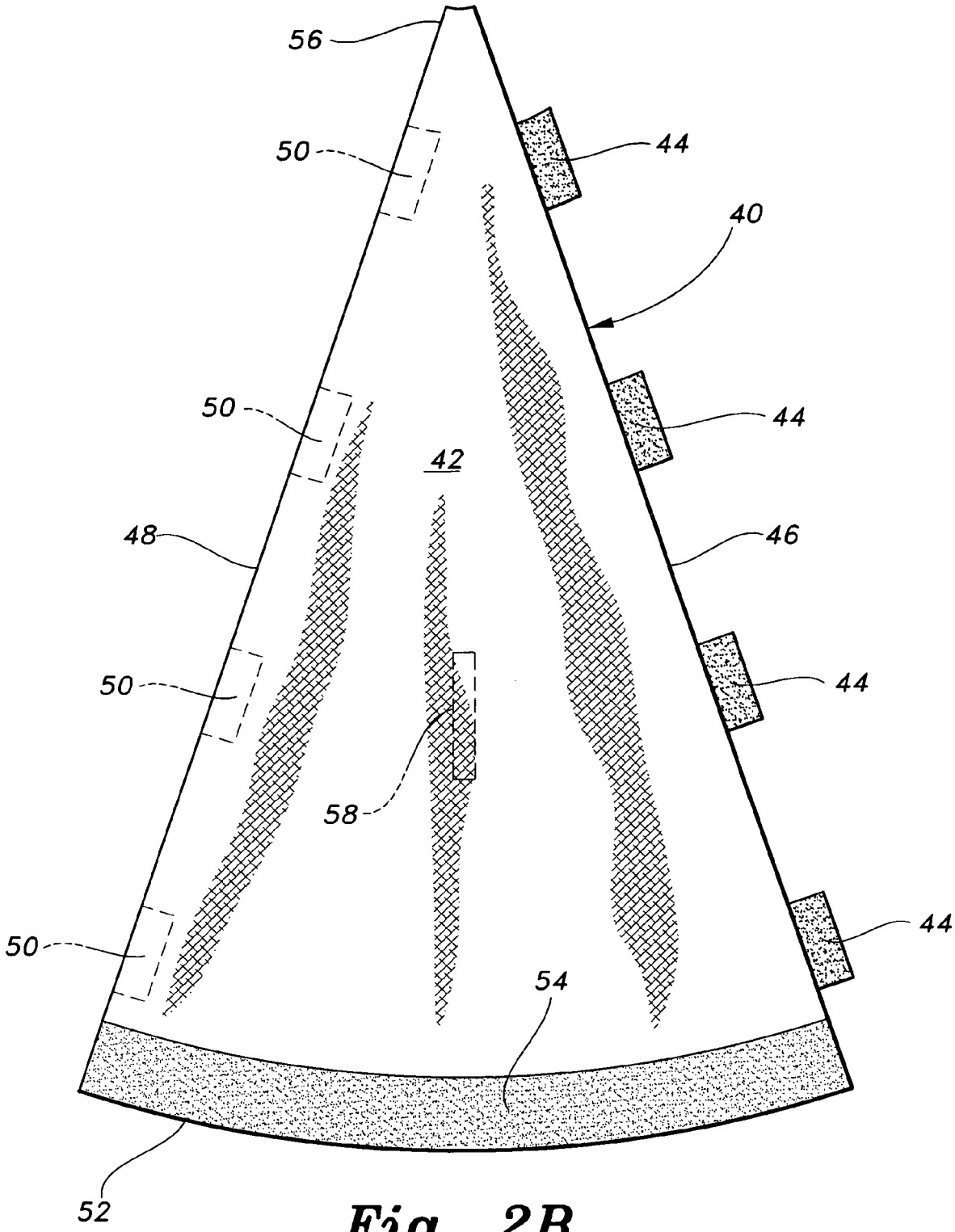
FIG. 2B is an inner side plan view of the cover section of the artificial tree system of FIG. 1.

Referring to FIGS. 2A and 2B, there are shown in plan view an inner side and an outer side, respectively, of a cover section 40 as laid flat. The cover section 40 is shown as one of three sections to form the assembled cover (see FIG. 3), however the number of sections may vary as a matter of choice. Cover section 40 has a sidewall 42 of canvass cloth or other appropriate material. Flaps 44 are spaced along and extend outward from cover section flap side edge 46 and are covered on their inner side by mating hook and loop material (VELCRO), preferably loop material. Hook and loop material patches 50 are spaced along cover section patch side edge 48 and secured to the outer side of sidewall 42, patches 50 preferably being of hook material. Sidewall 42 has a lower end 52 having an inner peripheral strip of hook and loop material 52, preferably hook material, which mates with the hook and loop material on the sidewall of base 30 (see FIG. 1). As preferred, the sidewall 31 of base 30 has a peripheral strip 34 of loop material thereon to mate with the inner peripheral strip 54 of hook material. Side edges 46 and 48 extend from lower end 52 to form an apex 56. A handle 50 is attached at a convenient height to at least one of the sidewalls 42 for ease in moving the covered tree to a desired position for display and for returning the covered tree to storage. Optional screened vents 59 are located in sidewalls 42 as shown in FIGS. 2A and 3 (see below) for ventilation of the system 10 during storage.

Figure 3:
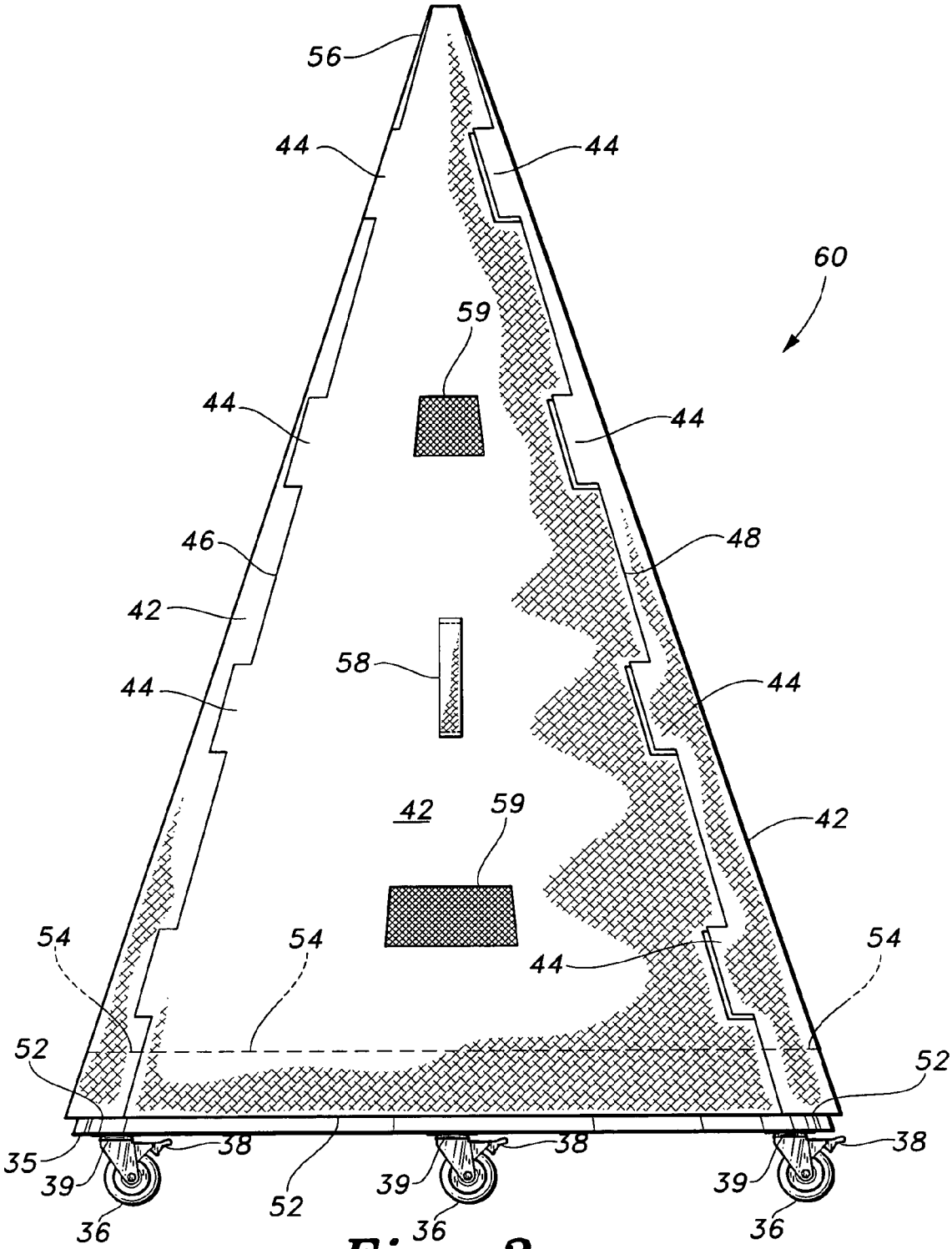
FIG. 3 is a plan view of the artificial Christmas tree system of FIG. 1 having the storage cover in place.

Referring to FIG. 3, there is shown the assembled cover 60 covering the tree 12 (not shown) as attached to base 30. Flaps 44 of a cover section 40 are shown mated with corresponding patches 50 (not shown) and hook material base connection strips 54 mate with the loop material covered base sidewall 34. The Christmas tree, as covered, is thus protected from dust and breakage of ornaments during storage between Christmas seasons.

Figure 4:
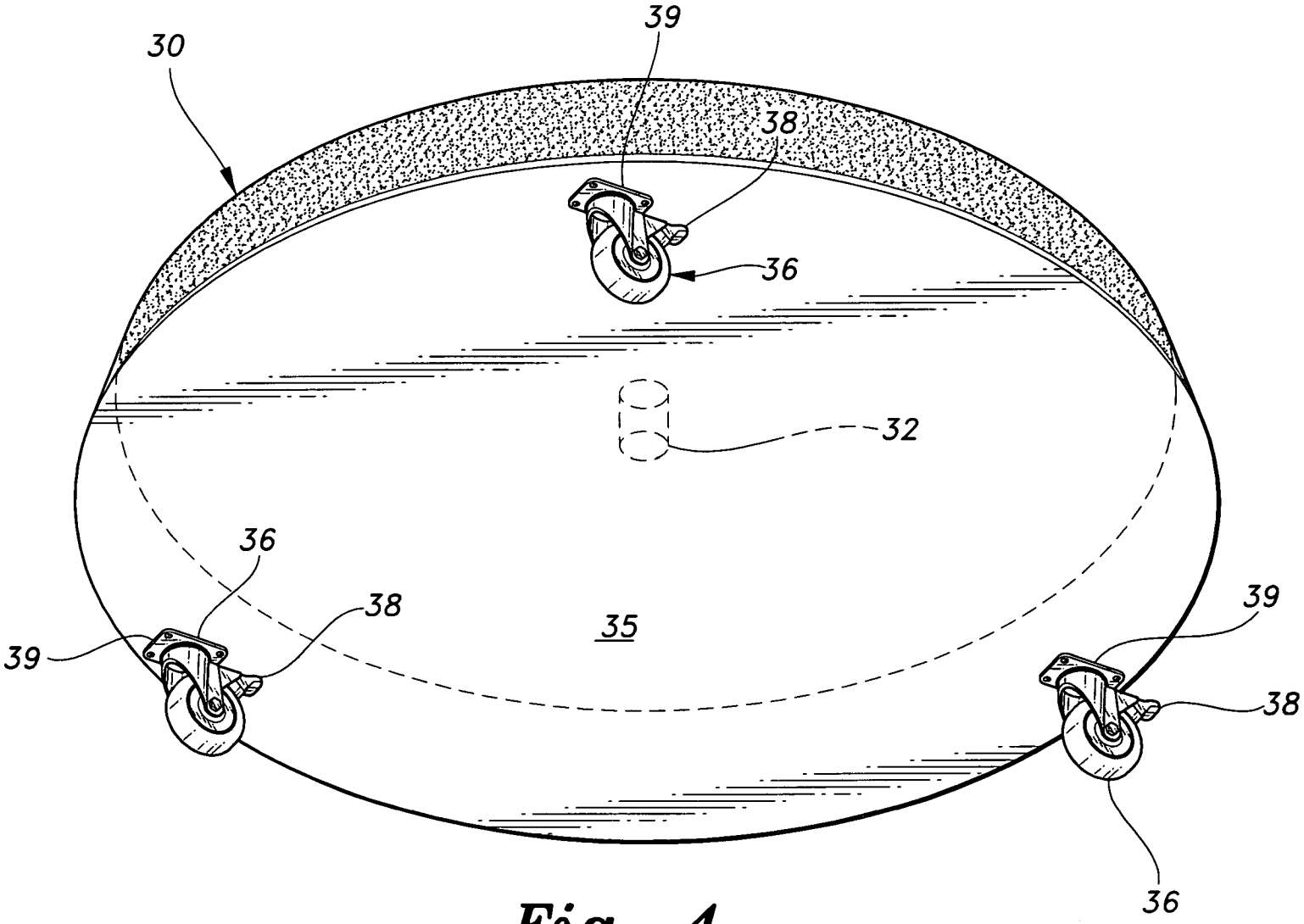
FIG. 4 is an upper perspective view of the base of the system of FIG. 1, the base being shown in ghost line illustrating the relative positions of the castor wheels.

Referring to FIG. 4, there is shown a perspective view of the base 30(shown in ghost line), illustrating the locations of swivel castor wheels 35 having brakes 38 and connected to base lower wall 35 by rotating castor mountings 39.

The Christmas tree and base may be made of commonly used material. The sections of the cover may be of cloth or rigid material with fabric flaps. The overall width of the tree, base, and cover may be of any desired size, and may selected to fit within a common doorjamb of 29" for moving between rooms. The tree and cover may be of any desired overall height, but is preferably about 6 ft. in height.

It is to be understood that the present invention is not limited to the embodiments described above, but encompasses any and all embodiments within the scope of the following claims.

We claim:

1. An artificial Christmas tree and cover system comprising:

an artificial Christmas tree having an artificial central trunk a plurality of radial artificial branches extending from said central trunk, said central trunk having a lower end;

a support base having an upper wall, a lower wall, and a peripheral sidewall and having a centrally located, vertical bore extending downward through said upper wall of such size and depth as to receive said central trunk lower end;

a generally upright, conical cover of such size and shape as to cover said artificial Christmas tree; and said cover being removably attachable to said peripheral sidewall, wherein said cover has an inner peripheral strip of one of hook and loop material around its inner, lower periphery, and said base has a peripheral strip of the other of said hook and loop material removably mating with the inner peripheral strip of hook and loop material of said cover;

whereby said cover may be removed to display said artificial Christmas tree; and whereby said cover may be placed over said Christmas tree while said tree is fully decorated and secured to said peripheral sidewall for storage between Holiday seasons.

2. The artificial Christmas tree and cover system of claim 1, wherein said base is generally cylindrical in shape and said strips of mating hook and loop material extend around the inner periphery of said cover and the outer periphery of said base.

3. The artificial Christmas tree and cover system of claim 1, wherein said cover comprises a plurality of generally triangular sections removably connected so as to form said conical cover.

4. The artificial Christmas tree and cover system of claim 3, wherein said triangular sections have first and second side edges extending to an apex and each said triangular section has one of hook and loop material along each said first edge on an outer side thereof and the other of mating hook and loop material along each said second edge on an inner side thereof so as to form said conical cover for storage of said Christmas tree and to allow its dismantlement for display of said Christmas tree.

5. The artificial Christmas tree and cover system of claim 4, wherein said first edge of said triangular section has spaced patches of said one of hook and loop material spaced therealong, and said second edge has spaced flaps extending therefrom corresponding to said spaced patches, said flaps having the other of said hook and loop material on the inner sides thereof so as to mate with said patches on an adjacent triangular section to form a conical cover, said base being generally cylindrical in shape and said strips of mating hook and loop material extending around the inner periphery of said cover and an outer periphery of said base.

6. The artificial Christmas tree and cover system of claim 5, wherein said base is frustoconical in shape, said sidewall tapering inward from said lower wall to said upper wall.

7. The artificial Christmas tree and cover system of claim 5, further comprising a plurality of swivel castor wheels mounted on said lower wall of said base, at least one of said castor wheels having a brake thereon, whereby said brake may be released for rolling movement of said tree and wherein said brake may be set to maintain said Christmas tree in a fixed position for display and for storage.

8. The artificial Christmas tree and cover system of claim 7, wherein said castor wheels are spaced about a periphery of said lower wall of said base and all said castor wheels have brakes.

9. The artificial Christmas tree of claim 7, further comprising a handle located at a convenient height on an outer side of at least one of said triangular cover sections.

10. The artificial Christmas tree of claim 9, wherein there are three of said triangular sections forming said conical cover.

11. The artificial Christmas tree of claim 10, wherein said trunk comprises an upper trunk tube having a lower end portion, a central trunk tube having a receiver sleeve at its upper end for receiving said lower end portion of said upper trunk tube, said central trunk tube having a lower end portion, and a lower trunk tube having a receiver sleeve at its upper end for receiving said lower end portion of said central trunk tube, said lower trunk tube having a lower end portion for insertion into said vertical bore of said base.

12. The artificial Christmas tree of claim 11, wherein said upper trunk tube defines an upper tree section, said central trunk tube defines a central tree section, and said lower trunk tube defines a lower tree section.

13. An artificial Christmas tree and cover system comprising:

an artificial Christmas tree having an artificial central trunk, a plurality of radial artificial branches extending from said central trunk, said central trunk having a lower end;

a support base having an upper wall, a lower wall, and a peripheral sidewall and having a centrally located, vertical bore extending downward through said upper wall of such size and depth as to receive said central trunk lower end;

a generally upright, conical cover of such size and shape as to cover said artificial Christmas tree;

said cover being removably attachable to said peripheral sidewall;

said cover having an inner peripheral strip of one of hook and loop around its inner, lower periphery, and said base has a peripheral strip of the other of said hook and loop material removably mated with the inner peripheral strip of hook and loop material of said cover; and said base being generally cylindrical in shape and said strips of mating hook and loop material extend around the inner periphery of said cover and an outer periphery of said base;

whereby said cover may be removed to display said artificial Christmas tree; and whereby said cover may be placed over said Christmas tree while said tree is fully decorated and secured to said peripheral sidewall for storage between Holiday seasons.

14. The artificial Christmas tree and cover system of claim 13, wherein said cover comprises a plurality of generally triangular sections removably connected so as to form said conical cover, and wherein each of said triangular sections has first and second side edges extending to an apex, said first edge of each said triangular section has spaced patches of one of hook and loop material spaced therealong, and said second edge has spaced flaps extending therefrom corresponding to said spaced patches, said flaps having the other of said hook and loop material on an inner side thereof so as to mate with said patches on an adjacent triangular section to form a conical cover.

15. The artificial Christmas tree and cover system of claim 14, further comprising a plurality of swivel castor wheels mounted on said lower wall of said base, at least one of said castor wheels having a brake thereon, whereby said brake may be released for rolling movement of said tree and wherein said brake may be set to maintain said Christmas tree in a fixed position for display and for storage.

16. The artificial Christmas tree and cover system of claim 15, wherein said castor wheels are spaced about a periphery of said lower wall of said base and all said castor wheels have brakes.

17. The artificial Christmas tree of claim 16, further comprising a handle located at a convenient height on an outer side of at least one of said triangular cover sections.

18. The artificial Christmas tree of claim 17, wherein said trunk comprises an upper trunk tube having a lower end portion, a central trunk tube having a receiver sleeve at its upper end for receiving said lower end portion of said upper trunk tube, said central trunk tube having a lower end portion, and a lower trunk tube having a receiver sleeve at its upper end for receiving said lower end portion of said central trunk tube, said lower trunk tube having a lower end portion for insertion into said vertical bore of said base.

19. An artificial Christmas tree and cover system comprising:

an artificial Christmas tree having an artificial central trunk, a plurality of radial artificial branches extending from said central trunk, said central trunk having a lower end;

a support base having an upper wall, a lower wall, and a peripheral sidewall and having a centrally located, vertical bore extending downward through said upper wall of such size and depth as to receive said central trunk lower end;

a generally upright, conical cover of such size and shape as to cover said artificial Christmas tree;

said cover being removably attachable to said peripheral sidewall;

said cover having an inner peripheral strip of one of hook and loop around its inner, lower periphery, and said base has a peripheral strip of the other of said hook and loop material removably mated with said first strip of hook and loop material;

said base being generally cylindrical in shape and said strips of mating hook and loop material extend around the inner periphery of said cover and an outer periphery of said base;

said cover comprising a plurality of generally triangular sections removably connected so as to form said conical cover;

each of said triangular sections having first and second side edges extending to an apex, said first edge of each said triangular section has spaced patches of one of hook and loop material spaced therealong, and said second edge has spaced flaps extending therefrom corresponding to said spaced patches, said flaps having the other of said hook and loop material on an inner side thereof so as to mate with said patches on an adjacent triangular section to form a conical cover; and a plurality of swivel castor wheels mounted on said lower wall of said base, at least one of said castor wheels having a brake thereon, whereby said brake may be released for rolling movement of said tree and wherein said brake may be set to maintain said Christmas tree in a fixed position for display and for storage;

whereby said cover may be removed to display said artificial Christmas tree; and whereby said cover may be placed over said Christmas tree while said tree is fully decorated and secured to said peripheral sidewall for storage between Holiday seasons.

* * * * *